US006748720B2

(12) United States Patent
Håkansson

(10) Patent No.: US 6,748,720 B2
(45) Date of Patent: Jun. 15, 2004

(54) CONTINUOUS APPARATUS IN DISTRIBUTION EQUIPMENT

(75) Inventor: Jan Håkansson, Eslöv (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/164,576

(22) Filed: Jun. 10, 2002

(65) Prior Publication Data

US 2003/0019186 A1 Jan. 30, 2003

Related U.S. Application Data

(63) Continuation of application No. PCT/SE00/02444, filed on Dec. 6, 2000.

(30) Foreign Application Priority Data

Dec. 10, 1999 (SE) ..... 9904514-8

(51) Int. Cl.[7] ..... B65B 51/10
(52) U.S. Cl. ..... 53/377.6; 53/377.2
(58) Field of Search ..... 53/376.4, 376.5, 53/377.2, 377.4, 377.5, 377.6, 378.3

(56) References Cited

U.S. PATENT DOCUMENTS

| | | | | |
|---|---|---|---|---|
| 3,307,329 A | * | 3/1967 | Lefief | 53/377.4 |
| 3,555,652 A | | 1/1971 | Ignell | |
| 3,699,742 A | | 10/1972 | Giraudi | |
| 3,716,962 A | * | 2/1973 | Langen et al. | 53/377.2 |
| 3,738,080 A | | 6/1973 | Reil | |
| 3,785,113 A | | 1/1974 | Mårtensson et al. | |
| 3,788,033 A | | 1/1974 | Mårtensson et al. | |
| 3,789,746 A | | 2/1974 | Mårtensson et al. | |
| 3,820,303 A | | 6/1974 | Mårtensson et al. | |
| 3,830,140 A | | 8/1974 | Rausing et al. | |
| 3,884,012 A | | 5/1975 | Ernstsson et al. | |
| 3,911,640 A | | 10/1975 | Rausing | |
| 3,918,237 A | | 11/1975 | Stark et al. | |
| 3,922,835 A | | 12/1975 | Reil | |
| 3,971,192 A | | 7/1976 | Soukup et al. | |
| 4,014,158 A | | 3/1977 | Rausing | |
| 4,017,247 A | | 4/1977 | Soukup et al. | |
| 4,026,090 A | * | 5/1977 | Loveland | 53/377.3 |
| 4,054,074 A | | 10/1977 | Mårtensson et al. | |
| 4,074,961 A | | 2/1978 | Reil | |
| 4,077,829 A | | 3/1978 | Pupp et al. | |
| 4,094,124 A | | 6/1978 | Ljungerantz | |
| 4,132,051 A | | 1/1979 | Rausing | |
| 4,151,024 A | | 4/1979 | Ohlsson | |
| 4,189,456 A | | 2/1980 | Rausing | |
| 4,196,035 A | | 4/1980 | Reil | |
| 4,203,795 A | | 5/1980 | Pupp et al. | |
| 4,293,369 A | | 10/1981 | Dilot et al. | |
| 4,372,797 A | | 2/1983 | Dilot et al. | |
| 4,384,438 A | | 5/1983 | Hilmersson | |

(List continued on next page.)

FOREIGN PATENT DOCUMENTS

| | | |
|---|---|---|
| EP | 0 820 931 A1 | 1/1998 |
| GB | 1173966 | 12/1969 |
| GB | 2065589 A | 7/1981 |
| WO | 97/03879 | 2/1997 |

*Primary Examiner*—Stephen F. Gerrity
(74) *Attorney, Agent, or Firm*—Burns, Doane, Swecker & Mathis, L.L.P.

(57) ABSTRACT

The disclosure relates to an apparatus in distribution equipment. The distribution equipment is of the type which marshals or groups together a number of objects into a unit and surrounds this unit with a continuous paperboard sheet. The paperboard sheet is folded in and glued along the one longitudinal side of the unit. The apparatus includes two cam curves which are disposed substantially parallel. The apparatus further includes an endless, driven chain which is parallel with the cam curves and on which a number of carriers are disposed. Each carrier consists of at least one inward folder and one hold-down device. The inward folder is disposed to follow the first cam curve and the hold-down device is disposed to follow the second cam curve.

5 Claims, 4 Drawing Sheets

U.S. PATENT DOCUMENTS 4,384,441 A 5/1983 Maruyama et al.
4,384,915 A 5/1983 Utsumi
4,448,008 A 5/1984 Pankratz et al.
4,462,202 A 7/1984 Reil
4,484,977 A 11/1984 Andersson
4,510,732 A 4/1985 Löthman
4,528,803 A 7/1985 Ott
4,557,888 A 12/1985 Rausing et al.
4,584,819 A 4/1986 Hakansson
4,646,507 A 3/1987 Ohlsson et al.
4,759,171 A 7/1988 Bruveris et al.
4,903,458 A 2/1990 Hakansson
4,969,308 A * 11/1990 Hakansson ..... 53/410
5,154,041 A 10/1992 Schneider
5,375,391 A 12/1994 Persson et al.
5,469,690 A 11/1995 Nordell
5,488,812 A 2/1996 Stark et al.
5,536,237 A 7/1996 Prince et al.
5,697,202 A 12/1997 Totilo
5,863,380 A * 1/1999 Gambetti ..... 53/377.4
5,966,899 A 10/1999 Fontanazzi
6,035,604 A 3/2000 Gustafsson
6,035,615 A 3/2000 Hansson et al.
6,038,838 A 3/2000 Fontanazzi
6,085,495 A 7/2000 Fontanazzi et al.
6,085,496 A 7/2000 Fontanazzi et al.
6,109,420 A 8/2000 Poppi et al.
6,112,498 A 9/2000 Hansson et al.

* cited by examiner

CONTINUOUS APPARATUS IN DISTRIBUTION EQUIPMENT

This application claims priority under 35 U.S.C. §§119 and/or 365 to Appln. No. 9904514-8 filed in Sweden on Dec. 10, 1999; the entire content of which is hereby incorporated by reference.

This application is a continuation of International Application No. PCT/SE00/02444 filed on Dec. 6, 2000.

FIELD OF THE INVENTION

The present invention relates to a continuous apparatus in distribution equipment of the type which marshals together a number of objects into a unit and surrounds this unit with a continuous paperboard sheet, the sheet being folded in and glued together along one longitudinal side of the unit.

BACKGROUND OF THE INVENTION

Many manufacturing industries need to marshal or group together their products into distribution units in order to facilitate transport and to protect the products. This also applies to dairies and juice factories when they pack their products in single-use disposable packages of the type which are manufactured from a packaging laminate. The packaging laminate normally consists of a core layer of paper or paperboard to which are laminated different layers of thermoplastic, and possibly an aluminium foil (Alifoil).

The packaging material is formed in a filling machine into a continuous tube. The tube is longitudinally joint scaled and filled with the intended contents, whereafter the tube is transversely sealed and severed in the transverse seals to form individual packaging containers. After final forming, the packaging containers depart from the filling machine on a conveyor in order to be packed together in some form of distribution equipment.

The distribution equipment together with which the apparatus may be employed is particularly suited for parallelepipedic packaging containers, but also other types of packaging containers which for the greater part fill out a distribution unit may occur. The distribution equipment is of the type which marshals or groups the packaging containers arriving at the equipment and places a desired number of packaging containers, constituting the unit, on a paperboard sheet. The paperboard sheet is intended to surround the grouped packaging containers on at least four sides, and the sheet is glued together along its one longitudinal side so that the sheet holds the packaging containers together. The paperboard sheet may also partly surround the fifth and sixth sides of the unit.

This type of distribution equipment has previously been difficult to make to operate continuously. Since the filling machines are constantly being developed, with increasing output capacities, and since they thereby produce a larger number of packaging containers per hour, the demands are also increasing for making distribution equipment operate more rapidly. By making the distribution equipment continuous in operation, increased output capacity will be achieved. Nevertheless, in the type of distribution equipment described above, it must be ensured that there is a sufficient stay time for the glued paperboard side. If the stay time is insufficient, the glue will not set and there is a risk of obtaining distribution units which do not hold together, and so the packaging containers can fall out and be damaged.

Many types of distribution equipment fold together and glue the sheet with the aid of different pneumatic cylinders or the like, which results in complex and expensive distribution equipment. Such equipment requires more maintenance and the component parts are expensive and complex to replace.

SUMMARY OF THE INVENTION

One object of the present invention is to realise an apparatus in distribution equipment which permits the distribution equipment to operate continuously, which results in higher output capacity for the equipment.

A further object of the present invention is that the apparatus permit a sufficiently long stay time for the glue to set and afford reliable glue joints.

Still a further object of the present invention is that the apparatus have components which are relatively simple and economical to replace and to maintain.

These and other objects have been attained according to the present invention in that the apparatus of the type described by way of introduction has been given the characterising feature that the apparatus includes two cam curves, a first cam curve and a second cam curve, which are disposed substantially parallel, and an endless, driven chain parallel with the cam curves and on which a number of dogs or carriers are disposed and where each carrier consists of at least one inward folder and one hold-down device, and where the inward folder is disposed to follow the first cam curve and the hold-down device is disposed to follow the second cam curve.

Preferred embodiments of the present invention have further been given the characterising features as set forth in the appended subclaims.

BRIEF DESCRIPTION OF THE DRAWINGS

One preferred embodiment of the present invention will now be described in greater detail hereinbelow, with reference to the accompanying Drawings. In the accompanying Drawings.

Figure 1:
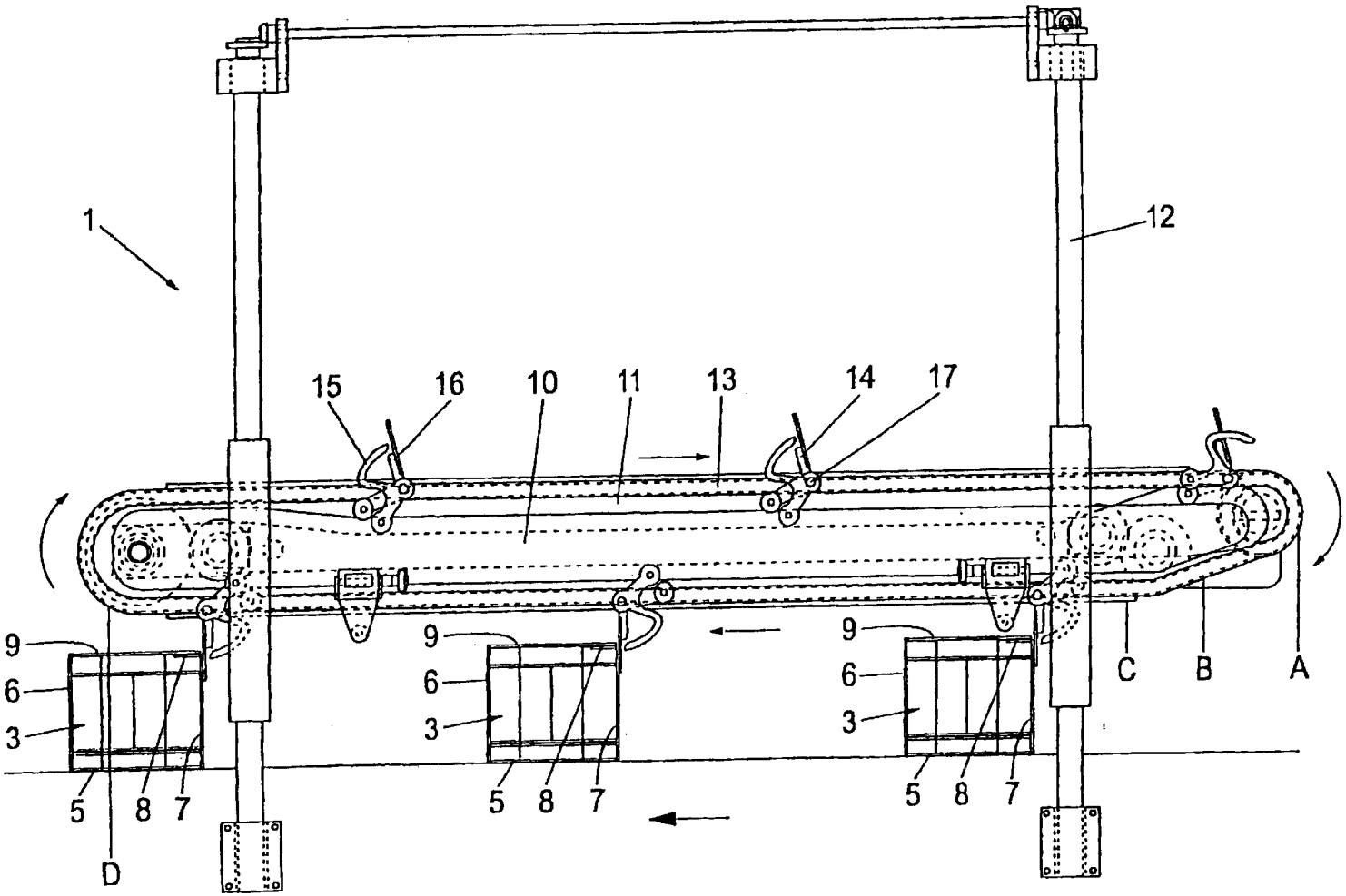
FIG. 1 is a side elevation of the apparatus according to the present invention, seen from one side.

The accompanying Drawings show only those details essential to an understanding of the present invention, and the placing, of the apparatus according to the present invention in the distribution equipment, which is well-known to a person skilled in the art, has been omitted.

DETAILED DESCRIPTION OF THE INVENTION

The apparatus 1 according to the present invention is included as a part in distribution equipment. A conventional conveyor (not shown), consisting of a driven, endless belt or chain, arrives at the distribution equipment and on which those objects 2 which are to be marshalled or grouped into distribution units are advanced. At the first workstation (not shown) in the distribution equipment, a preselected number of objects 2 are marshalled into a preselected packing pattern.

The thus grouped objects 2, which may consist of parallelepipedic packaging containers, are transferred in the next workstation (not shown) to a paperboard sheet 3. The paperboard sheet 3 is of the type which has prepared fold lines and which is intended to be folded together and to surround the marshalled or grouped objects 2 on at least four sides of the grouped objects 2. The paperboard sheet 3 is placed on a conveyor 4 which may consist of an endless, driven belt or chain. The grouped objects 2 thus stand on one side 5 of the paperboard sheet 3, and the conveyor 4 is provided with carriers which hold the two sides 6 and 7 of the sheet adjacent the bottom side 5 in place against the objects 2. One of the sides 7 also borders on a flap 8 which extends along the entire side 7. The other side 6 borders on the fourth side 9 of the sheet 3, which will constitute the top side 9 of the unit. The flap 8 is intended to be glued against the top side 9 along the one longitudinal side of the unit. The grouped objects 2 and the paperboard sheet 3 together constitute a distribution unit.

Figure 3A:
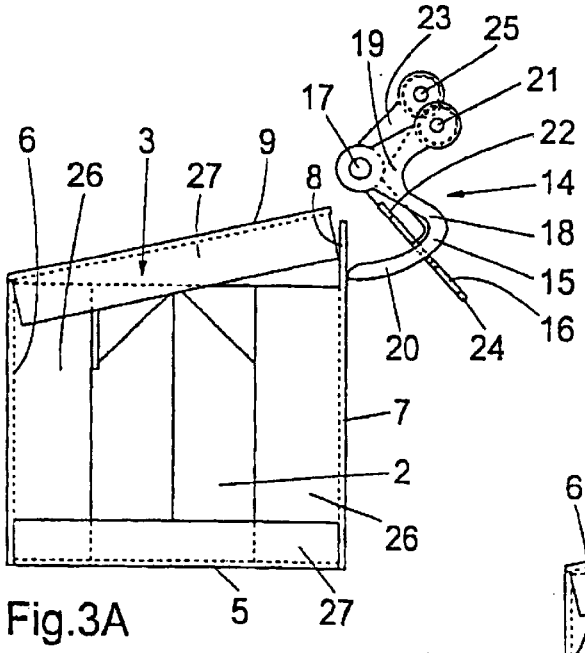
FIGS. 3A–C show different stages of the inward folding and hold-down operations.
Figure 4A:
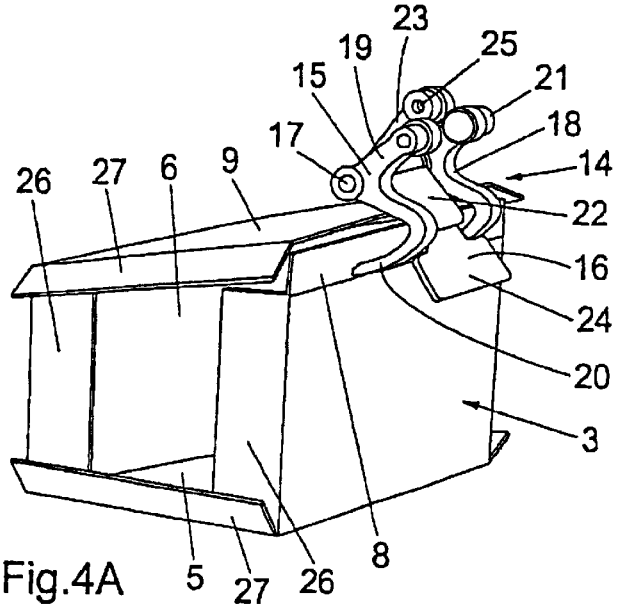
FIGS. 4A–C show different stages of the inward folding and hold-down operations.

When the objects 2 grouped on the paperboard sheet 3 reach the workstation which constitutes the apparatus 1 according to the present invention, the distribution unit is of an appearance as apparent from FIGS. 3A and 4A. Before the unit reaches the apparatus 1 according to the present invention, the paperboard sheet 3 has moreover been provided with the requisite glue on those parts 8, 9 of the sheet 3 which are to be glued together. The glue may consist of a molten thermoplastic, so-called hotmelt, which is sprayed on the paperboard sheet 3 from nozzles (not shown) when the paperboard sheet 3 passes on the conveyor 4.

The apparatus 1 according to the present invention includes two substantially parallel, fixed cam curves 10 and 11. The cam curves are secured in a frame 12. Parallel with the cam curves 10, 11, there is disposed a driven, endless chain 13. The chain 13 is driven by an electric motor. Operation is synchronised with the remaining parts of the distribution equipment. A number of dogs or carriers 14 are secured on the chain 13. In the preferred embodiment, the carriers 14 are six in number, uniformly distributed along the endless chain 13. The number of carriers 14 may vary, depending upon the capacity of the apparatus 1 or on the time lag which is required for the glue employed in the apparatus 1 to have time to set.

Each carrier 14 consists of at least one inward folder 15 and one hold-down device 16. In the preferred embodiment, each carrier 14 consists of two inward folders 15 and one hold-down device 16. The inward folder 15 and the hold-down device 16 have a common shaft 17. By means of the common shaft 17, the carrier 14 is fixedly secured in the chain 13.

The inward folder 15 has, from the common shaft 17, two shanks 18 and 19. The one shank 18 is terminated in a hooked portion 20. It is the hooked portion 20 which is disposed to carry out the inward folding, of the flap 8 so that it can be glued against the top side 9 of the paperboard sheet 3. The other shank 19 is terminated by a cam wheel 21. The cam wheel 21 is disposed to follow the first cam curve 10. When, as in the preferred embodiment, the carrier 14 consists of two inward folders 15 each with a cam wheel 21, the two cam wheels 21 are disposed to follow, the cam curve 10 on either side of the cam curve 10. The cam wheel 21 can follow the cam curve 10 in a groove provided in the cam curve 10 or alternatively be spring-biased.

The hold-down device 16 also has shanks 22, 23 from the common shaft 17. The one shank 22 is terminated by a pressure plate 24. The pressure plate 24 is disposed to press against the side 7 of the paperboard sheet 3 so that the glue between the flap 8 and the top side 9 will have time to set. The other shank 23 is terminated by a cam wheel 25 which is disposed to follow the second cam curve 11. The cam wheel 25 may follow the cam curve 11 in a groove provided on the cam curve 11, or alternatively be spring-biased.

Figure 2:
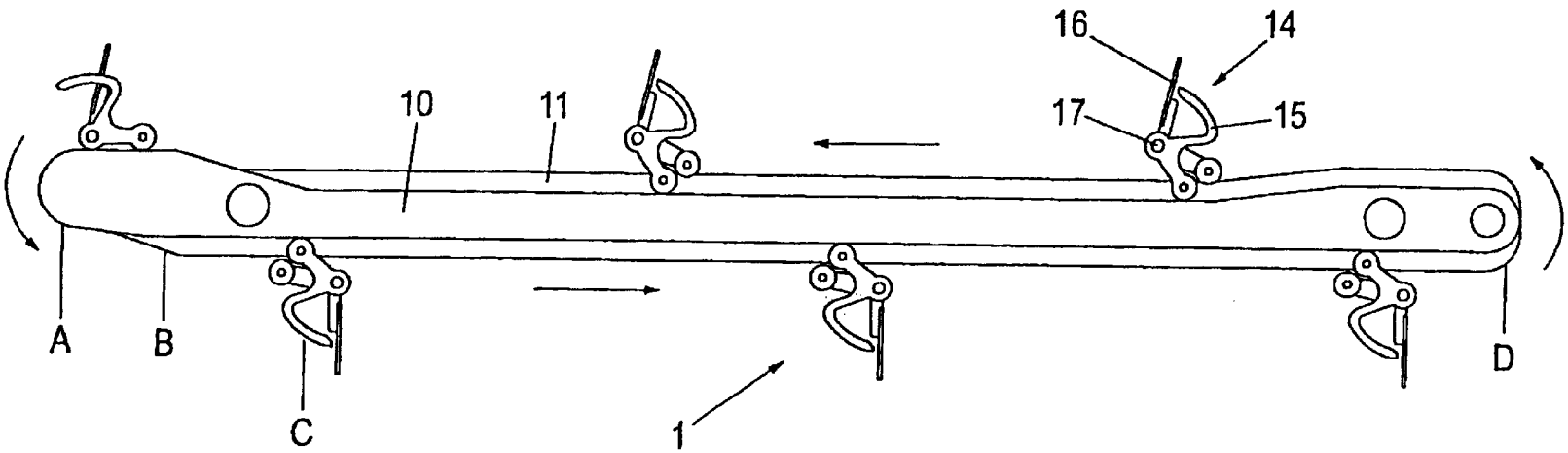
FIG. 2 is a simplified side elevation of the apparatus according to the present invention, seen from the other side.
Figure 3B:
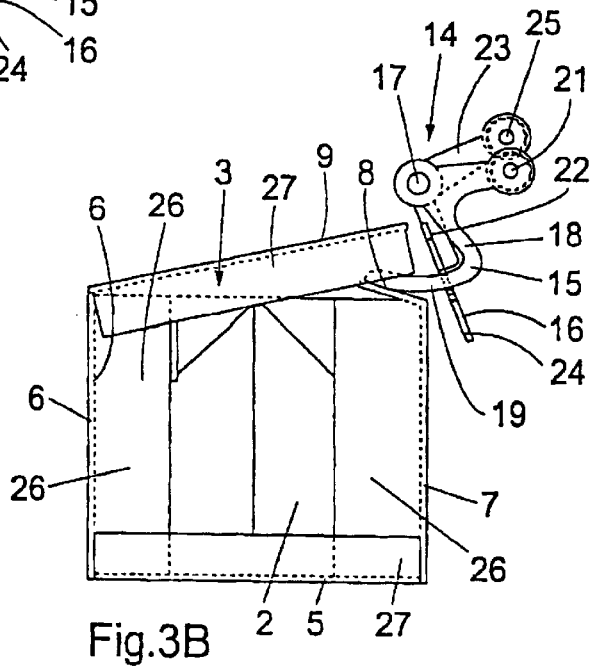
Figure 4B:
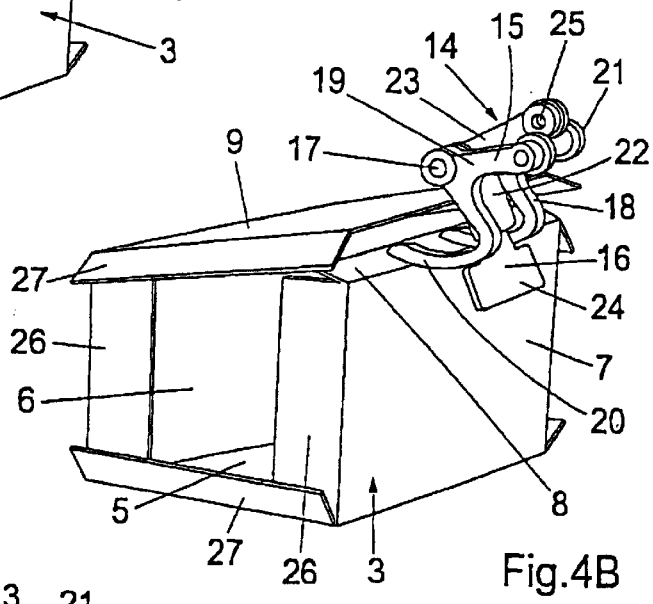

When a unit which has the appearance of the unit in FIG. 3A or 4A arrives at the apparatus 1, it is located in position A (see FIGS. 1 and 2). The inward folders 15 advance towards the flap 8 guided by the cam curve 10. The hold-down device 16 as yet is not in contact with the side 7 of the unit. In position B in FIGS. 1 and 2, the inward folders 15 fold in the flap 8 so that it comes in beneath the top side 9 of the paperboard sheet 3. The hold-down device 16, which is guided by the second cam curve 11, begins to approach the unit. The unit now has the appearance which is apparent from FIGS. 3B and 4B.

Figure 3C:
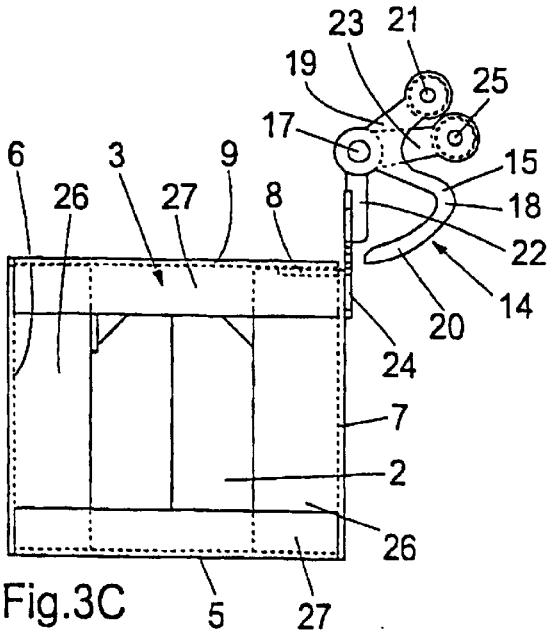
Figure 4C:
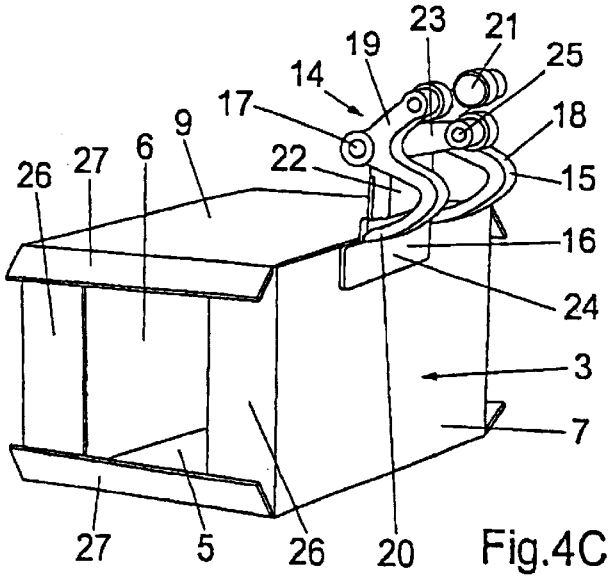

In position C, the unit has the appearance as shown in FIGS. 3C and 4C. The inward folders 15 have retreated from the flap 8 which is folded in under the top side 9, and the inward folders 15 are no longer in contact with the unit. The hold-down device 16 has moved against the side 7 of the paperboard sheet 3 and presses against it. At the same time as the unit reaches position C, rollers or the like (not shown) will press on the top side 9 from above so that the top side 9 is glued against the flap 8. Position C is retained until such time as the unit departs from the apparatus 1 at position D. The rollers or similar means which press down the top side 9 will also be engaged until position D. The time which elapses while the unit is displaced on the conveyor 4 between position C and position D is the time which is required for the glue between the flap 8 and the top side 9 to set and form a reliable glue joint. The distance, and thereby the time, can be varied depending upon what type of glue is employed. The direction of movement of the chain 13 is shown by means of slim arrows in FIGS. 1 and 2. The direction of movement of the conveyor 4 is shown by means of a slightly bolder arrow in FIG. 1.

The paperboard sheet 3 may also have flaps 26, 27 which wholly or partly surround the fifth and sixth sides of the unit. These flaps 26, 27 may be provided with glue at the same time as the flap 8 or alternatively at a different stage in the distribution equipment. The flaps 26, 27 may subsequently be glued together by means of rollers (not shown) or other means from the sides of the unit. The gluing together and pressing together of the flaps 26, 27 suitably take place while the unit is being displaced from position C to position D in the apparatus 1.

After the distribution unit leaves position D, it is wholly glued together and ready for further handling. The unit leaves the apparatus 1 on the conveyor 4 and it can thereafter be conveyed further on some form of conveyor (not shown) to additional distribution equipment, such as pallet loaders or the like.

As will have been apparent from the foregoing description, the present invention realises an apparatus which, in a simple and reliable manner, folds in and holds together a distribution unit so that a reliable glue joint will be obtained in the paperboard sheet which surrounds the unit. The apparatus is continuous in operation and thereby has a capacity which is adapted to today's high output capacity filling machines. The components included in the apparatus according to the present invention are simple to maintain and relatively economical to replace.

The present invention should not be considered as restricted to that described above and shown on the Drawings, many modifications being conceivable without departing from the scope of the appended Claims.

What is claimed is:

1. A continuous apparatus in distribution equipment of the type which marshals together a number of objects into a unit and surrounds this unit with a continuous paperboard sheet, the sheet being folded in and glued together along one longitudinal side of the unit, wherein the apparatus includes two cam curves, a first cam curve and a second cam curve, which are disposed substantially parallel, and an endless, driven chain parallel with the cam curves and on which a number of dogs or carriers are disposed and where each carrier has at least one inward folder and one hold-down device, and where the inward folder is disposed to follow the first cam curve and the hold-down device is disposed to follow the second cam curve.

2. The continuous apparatus as claimed in claim 1, wherein the inward folder and the hold-down device on the carrier have a common shaft by means of which the carrier is secured in the chain.

3. The continuous apparatus as claimed in claim 2, wherein the inward folder has two shanks departing from the common shaft, and in which the one shank has a hookshaped termination and in which the second shank is terminated by a cam wheel.

4. The continuous apparatus as claimed in claim 2, wherein the hold-down device consists of two shanks departing from the common shaft, and in which the one shank is terminated by a pressure plate and the other shank is terminated by a cam wheel.

5. The continuous apparatus as claimed in claim 1, wherein the carrier has a hold-down device and two inward folders.

* * * * *